United States Patent [19]

Mathur et al.

[11] Patent Number: 4,670,122

[45] Date of Patent: Jun. 2, 1987

[54] LOW OVER-VOLTAGE ELECTRODES FOR ALKALINE ELECTROLYTES

[75] Inventors: Indresh Mathur; Ram Gopal, both of Sarnia, Canada

[73] Assignee: The Dow Chemical Company, Midland, Mich.

[21] Appl. No.: 859,523

[22] Filed: May 5, 1986

[51] Int. Cl.[4] ..... C25B 11/06; C25B 11/10

[52] U.S. Cl. ..... 204/252; 204/84; 204/98; 204/128; 204/283; 204/290 R; 204/290 F; 427/126.6; 427/226; 427/377

[58] Field of Search ..... 204/84, 98, 128, 252, 204/283, 290 R, 290 F; 427/126.3, 126.6, 226, 377

[56] References Cited

U.S. PATENT DOCUMENTS 4,342,792 8/1982 Brown et al. ..... 427/34

4,358,475 11/1982 Brown et al. ..... 204/290 R 4,414,064 11/1983 Stachurski et al. ..... 204/290 R 4,428,805 1/1984 Caldwell et al. ..... 204/129

4,445,986 5/1984 McIntyre et al. ..... 204/98

4,464,239 8/1984 Tseung et al. ..... 204/129

FOREIGN PATENT DOCUMENTS 0009406 9/1979 European Pat. Off. .

*Primary Examiner*—Terryence Chapman

[57] ABSTRACT

This invention relates to novel electrocatalyst coated electrodes and to a method for the preparation thereof for use in electrochemical cells, particularly those employing alkaline electrolytes in the anolyte compartment of the cell. The electrodes disclosed are coated with the oxides of cobalt and tungsten and are particularly suitable as anodes since the electrocatalyst coatings resist destruction by oxygen.

14 Claims, No Drawings

LOW OVER-VOLTAGE ELECTRODES FOR ALKALINE ELECTROLYTES

BACKGROUND OF THE INVENTION (1) Field of the Invention

The invention relates to improved electrodes for use in electrolytic cells utilizing alkaline electrolytes.

(2) Description of the Prior Art

In an electrochemical cell having as basic components at least one anode and one cathode and an electrolyte, a chemical reaction may be achieved such as the oxidation or reduction of a chemical compound, as in an electrolytic cell or the conversion of chemical energy in a fuel into a low voltage direct current, as in a fuel cell. When the electrodes in such a cell are of relatively inexpensive material such as for instance iron or nickel, the electrodes tend to have low activity. The problem is particularly acute in electrochemical cells used, for example, in the electrolysis of water to produce hydrogen and oxygen utilizing an alkaline electrolyte (for instance a 25% aqueous solution of potassium hydroxide).

The use of nickel as an anode material for commercial water electrolyzers is unsatisfactory because the over-voltage for oxygen evolution on nickel is high and increases with length of service. Electrode coatings of mixed ruthenium-titanium oxides are useful for the production of oxygen in acidic solutions but the chemical stability of such anodes in a strongly alkaline environment, as used in water electrolyzers, is inadequate. Graphite which is useful as an anode for chlorine production is rapidly destroyed by oxygen if used for water electrolysis.

U.S. Pat. No. 4,342,792, electrocatalysts are disclosed which can be coated over a metal electrode substrate to provide an electrode of high activity and stability when used as an anode in a strongly alkaline electrolyte. Such anodes are produced by coating said electrode substrate with a homogeneous solution of a mixture of (1) at least one compound from the group of compounds consisting of iron, cobalt, nickel, and manganese, (2) at least one compound from the group of compounds consisting of molybdenum, tungsten, and vanadium, and (3) at least one rare earth metal selected from the compounds of lanthanides having an atomic number of 57–71 inclusive. When such compounds are coated on an electrode substrate, if such compounds are not oxides, the compound must be capable of thermodecomposition to the corresponding metal oxide. The oxide coated substrate is thereafter cured in a reducing atmosphere.

In U.S. Pat. No. 4,428,805, electrodes for oxygen manufacture are disclosed. The electrodes are prepared by coating an electroconductive substrate with a first coating of one or more oxides of the metals tin, lead, antimony, aluminum, and indium followed by a second coating of a monometal or a polymetal oxide having a spinel structure.

In U.S. Pat. No. 4,464,239, lithiated cobalto-cobaltic oxides are used as coatings for electrode substrates as a means for reducing the electrode over-voltage in a water electrolysis cell having an alkaline electrolyte.

In European Patent Publication No. 0,009,406, electrodes are disclosed having electrocatalytic coatings of the nickel-molybdenum type including mixtures of cobalt and tungsten. Such electrodes are coated on electrode substrates such as nickel, iron, copper, and titanium and their alloys from a solution of compounds of these metals. The compounds used must be capable of thermal decomposition to their oxides. Subsequently, the oxide coated substrate is cured in a reducing atmosphere.

SUMMARY OF THE INVENTION

An insoluble electrode, particularly an anode, for use in an electrochemical cell, especially an electrolytic cell where the electrode is an anode at which oxygen is evolved, can be prepared by coating an electrically conductive substrate with an effective electrocatalytic amount of cobalt and tungsten compounds, such as the nitrates and chlorides. The coating can be applied to said substrate from a homogeneous solution of a mixture of compounds of cobalt and tungsten. Said compounds are converted by thermodecomposition to their oxides subsequent to application of the coating to the electrically conductive substrate. The electrodes are stable to dissolution in strongly alkaline anolytes and exhibit low over-voltage initially and after long periods of service.

DETAILED DESCRIPTION OF THE INVENTION

Nickel is well known as the standard anode material for commercial water electrolyzers because of its good chemical stability in the normally employed 25-30% by weight concentration alkaline electrolyte. However, over the service life of the nickel electrode, the over-voltage for oxygen evolution increases. Reduced efficiency results, as indicated by low levels of operational current density. This leads to high capital costs for the operation of the cell. Low electrolyte concentrations such as 3 to 5% by weight alkali as used in the production of alkaline hydrogen peroxide are much more corrosive to a nickel electrode.

The voltage or potential that is required in the operation of an electrochemical cell such as an electrolytic cell includes the total of (1) the decomposition voltage of the compound being electrolyzed, (2) the voltage required to overcome the resistance of the electrolyte, and (3) the voltage required to overcome the resistance of the electrical connections within the cell. In addition, a potential known as "over-voltage"or "over-potential" is also required in the operation of the cell. The anode over-voltage is the difference between the thermodynamic potential of the oxygen evolving anode (for instance, when utilized for water electrolysis of a strongly alkaline anolyte) when the anode is at equilibrium and the potential of an anode on which oxygen is evolved due to an impressed electric current. The anode over-voltage is related to such factors as the mechanism of oxygen evolution and desorption, the current density, the temperature and the composition of the electrolyte, the anode material, and the surface area of the anode.

In recent years, increasing attention has been directed toward improving the oxygen over-voltage characteristics of electrolytic cell anodes, particularly those anodes utilized in the electrolysis of water as well as in the production of hydrogen peroxide where a strongly alkaline anolyte is utilized, for instance, a mixture comprising an alkali metal halide and 3 to 5% by weight an alkali metal hydroxide. Electrolytic cells for the production of an alkaline hydrogen peroxide preferably have at least two electrodes, an anode and a cathode, separated by a liquid permeable separator. Preferably the cathode is in physical contact with the separator and is porous and self-draining. In addition to having a reduced oxygen over-voltage, an anode for such purposes should also be constructed from materials which are inexpensive, easy to fabricate, mechanically strong, and capable of withstanding the environmental conditions of the electrolytic cell, and particularly capable of resisting dissolution in the alkaline anolyte.

The problem of increased over-potential with increasing service of nickel anodes under acidic conditions has been lessened by the recent adoption of coatings on electroconductive substrates of noble metals of Group VIII of the Periodic Table of the Elements. However, use of expensive metal coatings such as ruthenium oxide in the production of anodes for oxygen evolution has met with the problem of dissolution of the electrode coating in an alkaline electrolyte. Those metals, which, when coated on electroconductive substrates, do not dissolve in strongly alkaline anolytes during oxygen evolution, will generally be covered with an oxide film and suffer a loss of activity with increasing service. The electrodes of European Patent Application No. 0,009,406 having electrode catalyst coatings such as the mixed nickel-molybdenum type which subsequent to deposition are decomposed to their oxides by heating and thereafter exposed to a reducing atmosphere at elevated temperature, show a marked over-voltage improvement over those disclosed heretofore. Useful electroconductive substrates for use with such electrode catalyst coatings have been disclosed in the prior art as relatively inexpensive materials such as nickel, iron, copper, titanium, and alloys thereof or of other metallic substances coated with any of these materials.

The electrodes of the present invention have been found to be more effective when used in water electrolysis and particularly effective when used in the production of an alkaline hydrogen peroxide using an alkali concentration of about 3 to about 5% by weight. Such electrodes are prepared utilizing coatings of compounds of cobalt and tungsten over an electroconductive substrate. Preferably, the cobalt and tungsten compounds are deposited as mixtures on an electroconductive substrate consisting of nickel or a nickel coated electroconductive substrate such as nickel coated steel. The mixtures are deposited from a homogeneous solution of the cobalt and tungsten compounds which are capable of being thermally decomposed to the oxides. Such compounds can be, for instance, the nitrates or chlorides of cobalt and tungsten. Generally the weight ratio of cobalt to tungsten utilized in the preparation of the electrodes of the invention is respectively about 1:1 to about 5:1.

The homogeneous solution of the cobalt and metal compounds utilized for coating the electroconductive substrates in the formation of the anodes of the invention is defined as an intimate mixture of the respective solid metal compounds in their finely divided state, or a solid solution of the metal compounds, or a solution of the compounds in a solvent. An intimate mixture of the solid metal compounds can be prepared in advance or the compounds can be mixed immediately prior to contact with the electroconductive substrate to be coated. For instance, the compounds of cobalt and tungsten can be applied onto the electroconductive substrate either separately or simultaneously. The compounds of cobalt and tungsten can be sprayed directly onto the electroconductive substrate. Alternatively the cobalt and tungsten compounds can be present in a homogeneous solution in a solvent for the compounds. The solvent can be an aqueous solution or a mixture of an aqueous and organic solvent or an organic solvent solution of the compounds. For example, a lower alkyl compound such as methanol, ethanol, propanol, isopropanol or formamide or dimethyl formamide. The choice of a particular solvent will depend upon the solubility of the desired compounds of cobalt and tungsten.

If the homogeneous solution is a liquid, it can be applied to the electroconductive substrate to be coated by dipping, rolling, spraying, or brushing. The coated electroconductive substrate is thereafter heated in air at an elevated temperature to decompose the metal compounds, if not oxides, to the corresponding oxides. The decomposition is suitably carried out at a temperature between 250° centigrade and 1200° centigrade, preferably between 350° centigrade and 800° centigrade, most preferably between about 350° to about 550° centigrade. The operation of applying a coating of the homogeneous solution to the electroconductive substrate followed by thermodecomposition to the oxides can be repeated successively to ensure adequate coverage of the substrate with the metal oxides so as to provide a coating thickness of about 2 to about 200 microns. Coating thicknesses of from about 10 to about 50 microns are preferred while coatings of less than about 10 microns in thickness usually do not have acceptable durability and coatings of more than 50 microns usually do not produce any additional operating advantages.

The concentrations and relative proportions of the cobalt and tungsten compounds used in the homogeneous solution generally is respectively in the range of about 1:1 to about 5:1, but higher or lower proportions can be used. The concentration of the cobalt and tungsten compounds in the coating bath is not critical. Particularly good coatings are produced when the concentration of the cobalt ions in the bath is within the range of about 0.5% by weight to about 5% by weight and when the relative proportion of tungsten ions to cobalt ions in the bath is maintained at about 0.5:1.

The deposit of the homogeneous solution of cobalt and tungsten compounds or their oxides may be obtained by use of a sequential application of a mixture, an alloy, or an intermetallic compound, depending upon the particular conditions utilized in depositing the coating. Since any of these particular combinations of metals are within the scope of the present invention, the term "codeposit", or form thereof, as used in the present specification and claims, includes any of the various alloys, compounds and intermetallic phases of the cobalt and tungsten compounds or oxides of said compounds and does not imply any particular method of application or process of formulation with respect to these metal compounds used as electrocatalysts. While the electroconductive substrates to be coated most preferably are of nickel and nickel coated steel, other electrically conductive metal substrates can be used such as stainless steel or titanium or any electrically conductive metal substrate if coated with nickel.

The cobalt compounds used in making the homogeneous solution with tungsten compounds can be any thermally decomposable oxidizable compound which when heated in the above prescribed heating range will form an oxide of cobalt. The compound can be organic such as cobalt octoate (cobalt 2-ethyl hexanoate) but is preferably an inorganic compound such as cobalt nitrate, cobalt chloride, cobalt hydroxide, cobalt carbonate, and the like. Cobalt nitrate and cobalt chloride are especially preferred.

The tungsten compounds used in making the electrodes of the present invention can be any thermally decomposable oxidizable compound which when heated in the above prescribed heating range will form an oxide of tungsten. The compound can be organic such as tungsten octoate and the like but is preferably an inorganic compound such as tungsten nitrate, tungsten chloride, tungsten hydroxide, tungsten carbonate, sodium tungstate, and the like. Tungsten nitrate or tungsten chloride are especially preferred.

The following examples illustrate the various aspects of the invention but are not intended to limit its scope. Where not otherwise specified throughout this specification and claims, temperatures are given in degrees centigrade, and parts, percentages, and proportions are by weight.

EXAMPLE 1

Electrodes were prepared in accordance with the invention by preparing a homogeneous solution of 5% by weight cobalt chloride and 1% by weight tungsten chloride in isopropanol. The measured weight of cobalt chloride was 1%, the measured weight of tungsten chloride was 0.5%. Both components were prepared in a single homogeneous solution but individual solutions could be prepared separately and thereafter mixed to form the final solution. The compounds provide a solution which is clear and homogeneous.

A nickel plated steel expanded metal sample was used which was degreased in trichloroethane, etched by dipping in hydrochloric acid (about 20% by weight concentration) for a few seconds, and rinsed thoroughly in distilled water. Before coating, the water as removed from the sample by air drying and the sample was dried in an oven at a temperature of 60° to 90° C. A cocatalytic coating of the above mixture of cobalt and tungsten compounds was applied by dipping the nickel coated steel expanded metal into the homogeneous solution and subsequently drying the coated metal in heated air in a furnace at a temperature of 480° centigrade for a period of 10 to 12 minutes. The operation was repeated several times until a visibly satisfactory film of the metal oxides was formed on the nickel coated steel expanded metal. After the final dipping operation, the coated expanded metal was heated for one hour at 480° centigrade to convert the coated metal compounds to their oxides.

EXAMPLE 2

The electrode prepared by the process of Example 1 was tested as an anode in a water electrolysis cell using as an anolyte a 4% by weight aqueous solution of sodium hydroxide. The anode showed a start up potential at 0.45 amps per square inch of 0.56 volts (versus a saturated calomel electrode). After 104 days of operation the anode potential was 0.645 volts. The anode potential compares favorably with a nickel plated steel electroconductive substrate used as an anode without any cocatalytic coating. A nickel plated steel anode showed a start up potential when used in a similar electrolytic cell at 0.45 amps per square inch of 0.661 volts and after 86 days of operation an anode potential of 0.730 volts.

EXAMPLE 3

The electrode prepared by the process of Example 1 was also tested in an electrolytic cell utilized for the preparation of an alkaline hydrogen peroxide utilizing as the alkaline electrolyte an aqueous solution consisting of 4% by weight sodium hydroxide and 0.6% by weight sodium chloride. The initial start up cell voltage was 1.68 volts for the anode coated in accordance with the teaching of Example 1. (This compares with the initial start up cell voltage for an anode of nickel plated steel of 2.21 volts.) The hydrogen peroxide efficiency of the anode having a cocatalytic coating prepared in accordance with the process of Example 1 was 95% after 100 days of operation of the cell. (This compares with the hydrogen peroxide efficiency of the nickel plated steel anode which was only 77% after 82 days of operation of the electrolytic cell.)

The hydrogen peroxide efficiency is the actual amount of hydrogen peroxide produced by the passage of current divided by the theoretical amount of hydrogen peroxide expected to be produced as calculated by Coulombs law. For example, if 1.21 grams of hydrogen peroxide is produced in 40 minutes using a current of 3 amps, then the weight of hydrogen peroxide expected to be produced would be, by Coulombs law:

$$\frac{17.01 \times 3.0 \times 40 \times 60}{96500} = 1.2706 \text{ grams}$$

The hydrogen peroxide efficiency would be:

$$\frac{1.21}{1.2706} \times 100 = 95.2\%$$

EXAMPLE 4

Example 1 was repeated using a nickel expanded metal to prepare a coated anode. The anode was utilized in an electrolytic cell for the production of an alkaline hydrogen peroxide. The electrolyte fed to the cell was a 4% by weight aqueous solution of sodium hydroxide containing 0.5% by weight of sodium chloride. The current density was 0.5 amperes per square inch. The anode did not show any sign of corrosion up to 60 days of cell operation.

EXAMPLE 5

(Control-forming no part of this invention)

An uncoated nickel anode was used in an electrolytic cell under the condition described in Example 4. Within 2 days of cell operation, the uncoated anode showed signs of corrosion.

EXAMPLE 6

Example 1 was repeated using a nickel plated copper expanded metal to prepare a coated anode. The anode was tested in a water electrolysis cell using a 4% by weight aqueous sodium hydroxide solution. The initial anode potential was 0.745 volts (versus saturated calomel electrode).

EXAMPLE 7

(Comparative Example—forming no part of this invention)

An anode was prepared by applying a cobalt-molybdenum coating to a nickel substrated in accordance with the procedure described in European Patent Application No. 0,009,406 except the oxide-coated substrate was not cured in a reducing atmosphere at elevated temperature. The coated anode was tested in a water electrolysis cell under the conditions described in Example 2. The initial anode potential (versus a saturated calomel electrode) was 0.65 volts at 0.45 amperes per square inch. This compares to the initial anode (start up) potential of a nickel plated steel anode coated with cobalt and tungsten of 0.56 volts, as described in Example 2.

EXAMPLE 8

(Comparative Example—forming no part of this invention)

An anode was prepared by applying a nickel-molybdenum-cerium coating to a nickel substrate in accordance with the procedure described in U.S. Pat. No. 4,342,792 except that the oxide coated substrate was not cured in a reducing atmosphere at elevated temperature. The initial anode potential when tested in a water electrolysis cell was 0.88 volts (versus a saturated calomel electrode). This compares with an initial anode potential of 0.56 volts, as described in Example 2 for an anode having a cobalt-tungsten coating on a nickel plated steel substrate.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

The embodiments of the invention in which an exclusive property or priviledge is claimed are defined as follows:

1. A method of producing an electrode for use in an electrolytic process, said electrode having electrocatalysts deposited on an electrically conductive substrate wherein said substrate is selected from the group consisting of nickel, stainless steel, titanium, and a nickel coated substrate and wherein said electrocatalysts consist of the oxides -of cobalt and tungsten; said method consisting of:

(A) codepositing on said substrate a homogeneous solution of compounds of cobalt and tungsten, each of which compound, when not an oxide, being capable of thermodecomposition to the corresponding oxide and (B) thermally decomposing said compounds of cobalt and tungsten, which are present other than in the oxide form, to the corresponding oxide.

2. The method of claim 1 wherein said homogeneous solution consists of a solvent and metal compounds of cobalt and tungsten in a weight ratio, respectively, of about 1:1 to about 5:1 and said electrode is an anode.

3. The method of claim 2 wherein said homogeneous solution consists of the nitrates or chlorides of cobalt and tungsten.

4. The method of claim 3 wherein said homogeneous solution is codeposited on said substrate by brushing, roll coating, or by dipping said substrate into said homogeneous solution wherein said solvent is selected from the group consisting of at least one of an aqueous solvent, a fixed aqueous and organic solvent, and an organic solvent.

5. The method according to claim 4 wherein said solvent is a lower alkyl alcohol and said substrate is coated with said metal compounds, other than the oxides, and is thereafter heated at an elevated temperature to convert said compounds to the corresponding oxides.

6. The method of claim 5 wherein successive applications of said homogeneous solution are applied to said substrate followed by successive heating at said elevated temperature to convert said metal compounds to the corresponding oxides.

7. An electrode for use in an electrolytic cell, said electrode comprising an electrically conductive substrate selected from the group consisting of nickel, stainless steel, titanium, and a nickel coated substrate, said electrically conductive substrate having a coating thereon of an effective, electrocatalytic amount of the oxides of cobalt and tungsten, and said electrode being produced by the process of claim 1.

8. The electrode of claim 7 wherein the electrically conductive substrate consists of nickel or nickel coated steel and said electrolytic cell is suitable for reacting a liquid with a gas.

9. The electrode of claim 8 wherein the thickness of said coating is about 2 to about 200 microns, said gas is an oxygen containing gas, and the weight ratio of cobalt to tungsten is, respectively, about 1:1 to about 5:1.

10. The electrode of claim 9 wherein said electrode is an anode and said electrolytic cell is suitable for the electrolysis of a mixture comprising an aqueous solution of an alkali metal hydroxide to produce an alkaline hydrogen peroxide aqueous solution.

11. In an electrolytic cell comprising at least two electrodes, an anode and a cathode, separated by a liquid permeable separator, wherein said cathode is in physical contact with said separator and is porous and self-draining; the improvement comprising using as said anode an electrically conductive substrate coated with an effective, electrocatalytic amount of the oxides of cobalt and tungsten, and said anode being produced by the process of claim 1.

12. The electrolytic cell of claim 11 wherein said substrate is selected from the group consisting of nickel, stainless steel, titanium, and a nickel coated substrate and said cell is suitable for reacting a liquid with a gas.

13. The electrolytic cell of claim 12 wherein said substrate consists of nickel or nickel coated steel, the thickness of said coating is about 2 to about 200 microns, and the weight ratio of cobalt to tungsten is, respectively, about 1:1 to about 5:1.

14. The electrolytic cell of claim 13 wherein said gas is an oxygen containing gas and said cell is utilized for the electrolysis of an aqueous mixture comprising an alkali metal hydroxide and an alkali metal halide to produce an alkaline solution of hydrogen peroxide.

* * * * *